US006393227B1

(12) United States Patent
Weaver et al.

(10) Patent No.: US 6,393,227 B1
(45) **Date of Patent: *May 21, 2002**

(54) IMAGE FORMING DEVICES, IMAGING ASSEMBLIES OF IMAGE FORMING DEVICES, AND METHODS OF FORMING AN IMAGE UPON MEDIA

(75) Inventors: Jeffrey S. Weaver; James G. Bearss; Thomas Camis, all of Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 09/659,655

(22) Filed: Sep. 8, 2000

Related U.S. Application Data

(63) Continuation of application No. 09/348,149, filed on Jul. 6, 1999, now Pat. No. 6,157,793.

(51) Int. Cl.[7] ..... G03G 15/00
(52) U.S. Cl. ..... 399/45; 399/66
(58) Field of Search ..... 399/45, 66, 313, 399/314, 388, 389; 73/159

(56) References Cited

U.S. PATENT DOCUMENTS

| | | | | |
|---|---|---|---|---|
| 4,610,530 A | | 9/1986 | Lehmbeck et al. | |
| 4,822,977 A | | 4/1989 | Leising et al. | 219/216 |
| 5,056,042 A | | 10/1991 | Lieb | 364/519 |
| 5,361,124 A | | 11/1994 | Rowe et al. | |
| 5,486,903 A | | 1/1996 | Kanno et al. | |
| 5,512,992 A | | 4/1996 | Kim et al. | |
| 5,557,427 A | | 9/1996 | Kamiya | 358/496 |
| 5,568,229 A | | 10/1996 | Szlucha | |
| 5,689,757 A | | 11/1997 | Ferrante et al. | 399/45 |
| 5,822,651 A | | 10/1998 | Yim et al. | 399/66 |
| 5,887,219 A | | 3/1999 | Eom | 399/45 |
| 5,905,925 A | | 5/1999 | Kawabata et al. | 399/45 |
| 5,934,140 A | | 8/1999 | Jackson et al. | 73/159 |
| 5,956,543 A | | 9/1999 | Aslam et al. | 399/45 |
| 5,966,559 A | | 10/1999 | May et al. | 399/45 |
| 6,055,008 A | | 4/2000 | Bliss | 347/133 |
| 6,157,793 A | * | 12/2000 | Weaver et al. | 399/45 |

FOREIGN PATENT DOCUMENTS

| | | |
|---|---|---|
| JP | 8-292662 | 11/1996 |
| JP | 10-153927 | 6/1998 |

OTHER PUBLICATIONS

United Kingdom Search Report.

* cited by examiner

*Primary Examiner*—William J. Royer

(57) ABSTRACT

The present invention includes image forming devices, imaging assemblies, sensors, and methods of forming an image. One aspect of the present invention provides an image forming device including a housing configured to guide media along a media path: an input device configured to receive an image; a sensor adjacent the media path and configured to monitor the media and to generate a signal responsive to the monitoring; and an imager adjacent the media path and configured to provide developing material corresponding to the image upon the media according to an imaging parameter and to adjust the imaging parameter responsive to the signal.

23 Claims, 7 Drawing Sheets

IMAGE FORMING DEVICES, IMAGING ASSEMBLIES OF IMAGE FORMING DEVICES, AND METHODS OF FORMING AN IMAGE UPON MEDIA

RELATED PATENT DATA

This patent resulted from a continuation application of prior application Ser. No. 09/348,149, filed on Jul. 6, 1999, now U.S. Pat. No. 6,157,793, entitled "Image Forming Devices and Sensors Configured to Monitor Media, and Methods of Forming an Image Upon Media".

FIELD OF THE INVENTION

The present invention relates to image forming devices, imaging assemblies, sensors, and methods of forming an image.

BACKGROUND OF THE INVENTION

Electrophotographic processes for forming images upon media are well known in the art. Typically, these processes include an initial step of charging a photoreceptor which may be provided in the form of a drum or continuous belt having photoconductive material. Thereafter, an electrostatic latent image may be produced by exposing the charged area of the photoreceptor to a light image using a light-emitting diode array, or scanning the charged area with a laser beam in exemplary configurations.

Particles of toner may be applied to the photoreceptor upon which the electrostatic latent image is disposed such that the toner particles are transferred to the electrostatic latent image. Thereafter, a transfer step occurs wherein the toner particles are transferred from the photoreceptor to the media while maintaining the shape of the image formed upon the photoreceptor. A fusing step is utilized to fix the toner particles in the shape of the image to the media. A subsequent step can include cleaning or restoring the photoreceptor for a next printing cycle.

Two operational parameters greatly affect the final print quality of the toner image supplied to the media. For example, the electric field in the transfer nip of an electrophotographic printing device and an effective temperature in the fuser nip are vital to ensure optimized image quality and achievable print. Two variables in printing media that affect the electric fields in the transfer nip and the effective temperature in the fuser nip are basis weight and water content. These two variables manifest themselves as differences in dielectric thickness, heat capacity and thermal conductivity for a given media in an environment.

Referring to toner transfer operations, toner transfer electric fields are largely dependent upon the capacitance of the media. Most transfer systems of conventional electrophotographic devices use constant supply voltages that are applied to respective conductive transfer rollers. Typically, the applied voltages are set relatively high to accommodate thicker (i.e., lower capacitance) media. Unfortunately, this condition can result in less than optimum electric fields for thinner (i.e., higher capacitance) media. In some conventional arrangements, a user can manually adjust fuser temperatures using a control panel or software. Typically, such adjustments are made after problems in fusing quality are noticed.

The above conventional image forming system configurations have associated drawbacks of requiring knowledge of the user to implement transfer and fusing adjustments as well as knowledge of the proper adjustment to improve transfer and fusing quality. Therefore, a need exists to provide image forming devices and methods which provide improved print quality for different types of media.

SUMMARY OF THE INVENTION

The present invention includes image forming devices, imaging assemblies, sensors, and methods of forming an image. One aspect of the present invention provides an image forming device comprising: a housing configured to guide media along a media path; an input device configured to receive an image; a sensor adjacent the media path and configured to monitor the media and to generated signal responsive to the monitoring: and an imager adjacent the media path and configured to provide developing material corresponding to the image upon the media according to an imaging parameter and to adjust the imaging parameter responsive to the signal.

A second aspect of the invention provides an imaging assembly of an image forming device comprising: a sensor configured to monitor media traveling along a media path of an image forming device and to generate a signal responsive to the monitoring; a controller coupled with the sensor and configured to receive the signal and to adjust an imaging parameter responsive to the signal; and an imager adjacent the media path and coupled with the controller and configured to provide developing material upon the media according to the imaging parameter.

According to another aspect, the invention provides a sensor configured to monitor media comprising: a first electrode positioned adjacent a first surface of media to be monitored; a second electrode positioned adjacent a second surface of the media; and wherein the first electrode and second electrode are substantially aligned to form a capacitor, and the media provides a dielectric material intermediate the first electrode and the second electrode.

Another aspect of the present invention includes a method of forming an image upon media comprising: providing an image forming device; providing an image; transferring developing material corresponding to the image to media according to an imaging parameter; monitoring the media; and adjusting the imaging parameter responsive to the monitoring.

Other features and advantages of the invention will become apparent to those of ordinary skill in the art upon review of the following detailed description, claims, and drawings.

DESCRIPTION OF THE DRAWINGS

Preferred embodiments of the invention are described below with reference to the following accompanying drawings.

FIG. 7 is a schematic representation of exemplary conditioning circuitry.

DETAILED DESCRIPTION OF THE INVENTION

The protection sought is not to be limited to the disclosed embodiments, which are given by way of example only, but instead is to be limited only by the scope of the appended claims.

Figure 1:
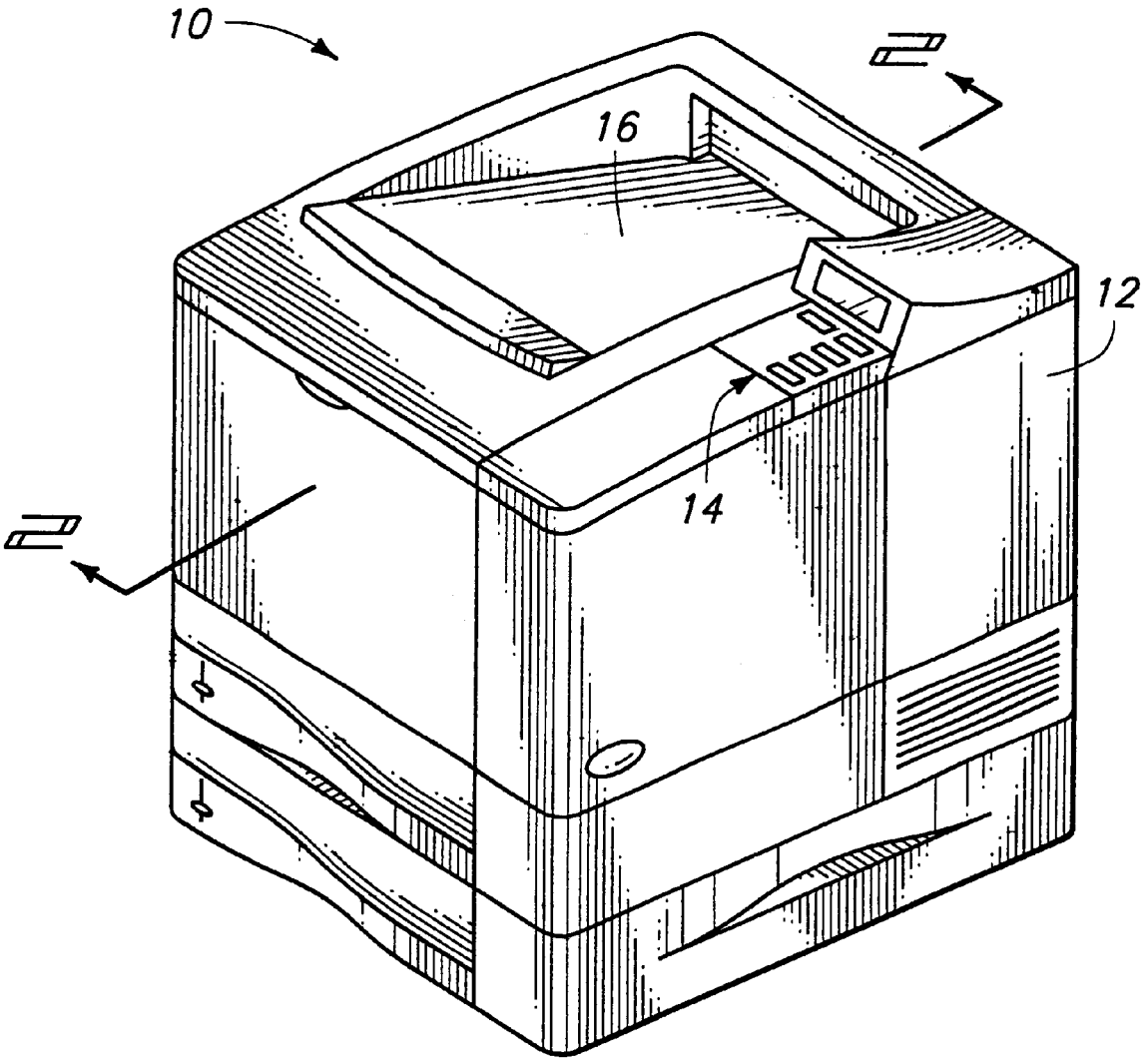
FIG. 1 is an isometric view of an image forming device.

Referring to FIG. 1, an exemplary image forming device 10 embodying the present invention is illustrated. The depicted image forming device 10 comprises an electrostatographic printer, such as an electrophotographic or electrographic printer. In alternative embodiments, image forming device 10 is provided in other configurations, such as facsimile or copier configurations.

The illustrated image forming device 10 includes a housing 12 arranged to house internal components (not shown in FIG. 1). A user interface 14 is provided upon an upper surface of housing 12. User interface 14 includes a key pad and display in an exemplary configuration. A user can control operations of image forming device 10 utilizing the key pad of user interface 14. In addition, the user can monitor operations of image forming device 10 using the display of user interface 14. An outfeed tray 16 is also provided within the upper portion of housing 12. Outfeed tray 16 is arranged and positioned to receive outputted printed media. Outfeed tray 16 provides storage for convenient removal of the printed media from image forming device 10. Exemplary media includes paper, transparencies, envelopes, etc.

Figure 2:
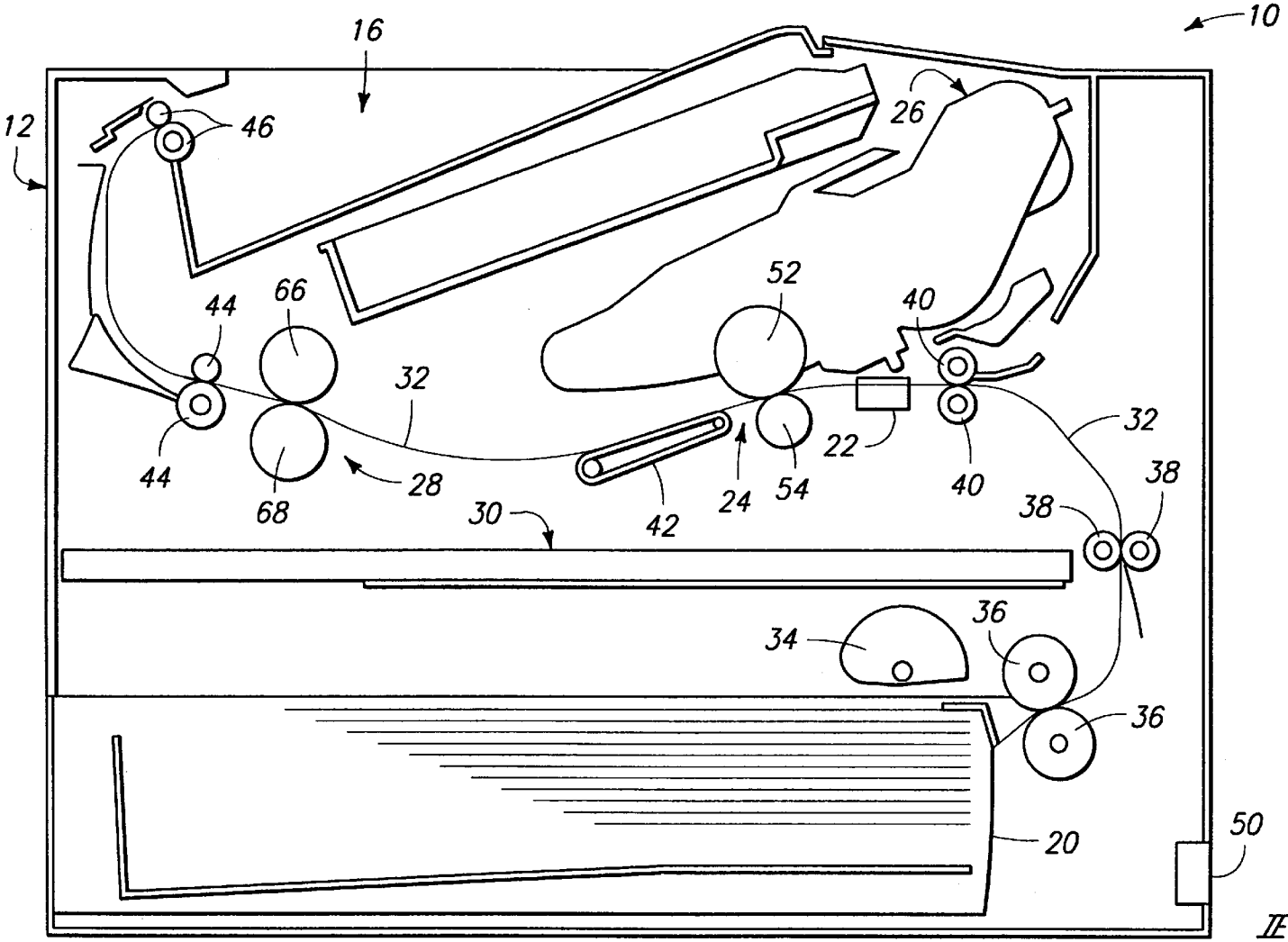
FIG. 2 is a cross-sectional view of the image forming device of FIG. 1.

Referring to FIG. 2, various internal components of an exemplary configuration of image forming device 10 are shown. The depicted image forming device 10 includes a media supply tray 20, sensor 22, imager 24, developing assembly 26, fuser 28, and controller 30. A media path 32 is provided through image forming device 10. Plural rollers are provided along media path 32 to guide media in a downstream direction from media supply tray 20 towards outfeed tray 16. More specifically, a pick roller 34, feed rollers 36, transport rollers 38, registration rollers 40, conveyor 42, delivery rollers 44, and output rollers 46 are arranged as shown to guide media along media path 32.

Image forming device 10 includes an input device 50 configured to receive an image in the described printer configuration. An exemplary input device 50 includes a parallel connection coupled with an associated computer or network (not shown). Such a coupled computer or network could provide digital files (e.g., page description language (PDL) files) corresponding to an image to be produced within image forming device 10.

Developing assembly 26 is positioned adjacent media path 32 and provides developing material, such as toner, for forming images. Developing assembly 26 is preferably implemented as a disposable cartridge for supplying such developing material.

Sensor 22 is positioned adjacent media path 32 and monitors media being printed upon and generates a characteristic signal responsive to the monitoring. Sensor 22 can monitor one or more properties of the media. More specifically, sensor 22 can be configured to determine a qualitative characteristic and/or quantitative characteristic of media being printed upon and generate the characteristic signal indicative of the qualitative and/or quantitative characteristics. As described below, sensor 22 can be configured to monitor qualitative characteristics, such as the electrical capacitance of the media.

Sensor 22 can additionally monitor quantitative characteristics, such as physical dimensions (e.g., physical thickness) of the media. Sensor 22 is preferably positioned to cause minimal vibration of media sheets 18 being monitored so as to not interfere with the static adhesion of developing material 61 to media sheets 18.

Imager 24 is positioned adjacent media path 32 and provides developing material upon media passing adjacent imager 24 corresponding to an image received via input 50. Fuser 28 is adjacent media path 32 and is located downstream from imager 24 within image forming device 10. Fuser 28 fuses the developing material corresponding to the received image to the media.

Figure 3:
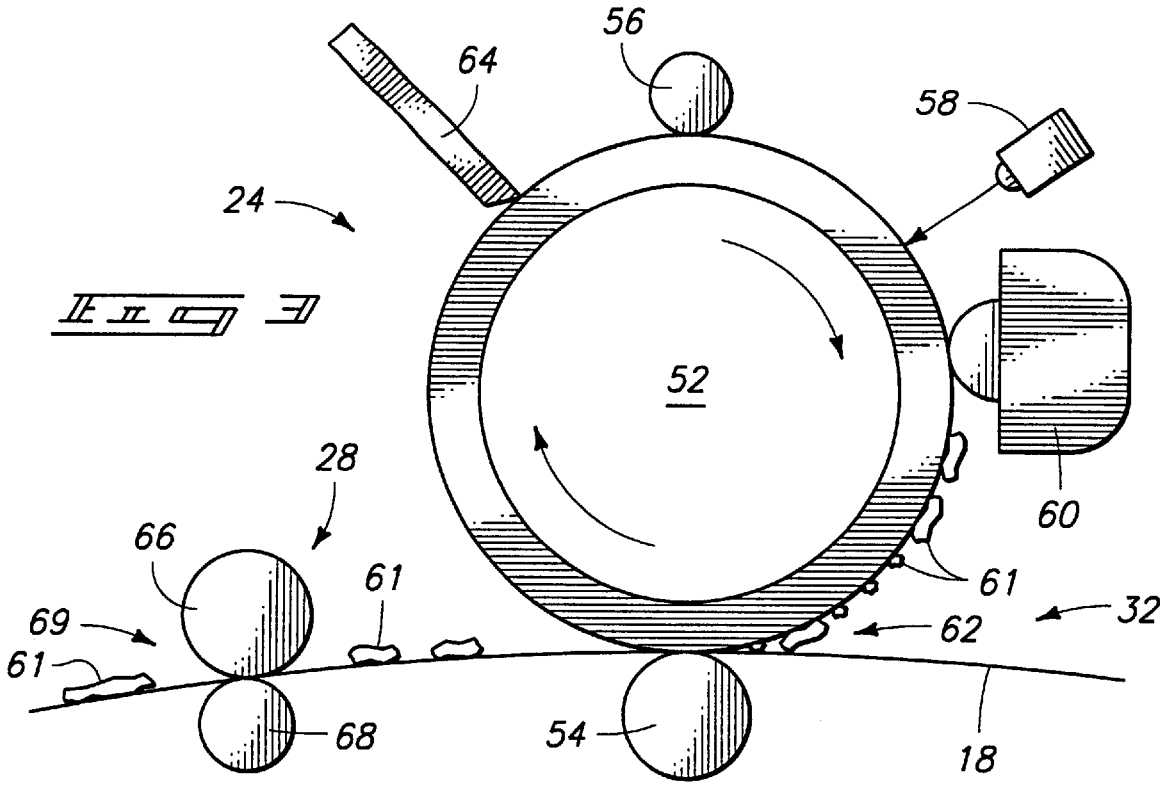
FIG. 3 is an illustrative representation of an imager and a fuser of the image forming device.

Referring to FIG. 3, further details of image forming operations of image forming device 10 are described. The depicted imager 24 includes an imaging roller 52 and transfer roller 54. Imaging roller 52 is a photoconductor which is insulative in the absence of incident light and conductive when illuminated. Imaging roller 52 may be implemented as a belt in an alternative configuration.

Imaging roller 52 rotates in a clockwise direction with reference to FIG. 3. The rotating imaging roller 52 is charged uniformly by a charging device such as charging roller 56. Charging roller 56 provides a negative charge upon the surface of imaging roller 52 in the described configuration. A laser device 58 scans across the charged surface of imaging roller 52 and writes an image to be formed by selectively discharging areas upon imaging roller 52 where toner is to be printed. A developer 60 applies developing material 61 adjacent imaging roller 52. Negatively-charged developing material 61 is attracted to discharged areas upon imaging roller 52 corresponding to the image and repelled from charged areas thereon.

A media sheet 18 traveling along media path 32 passes imaging roller 52 and transfer roller 54 at a transfer nip 62. Media sheet 18 can comprise an individual sheet or one sheet of a continuous web. The developed image comprising the developing material is transferred to media sheet 18 within transfer nip 62. A bias voltage is applied to transfer roller 54 positioned below passing media sheet 18 in FIG. 3.

Application of the voltage bias to transfer roller 54 induces an electric field through media sheet 18. The magnitude of the induced field is determined by the bias voltage, the resistivity of media sheet 18 and the dielectric thickness of media sheet 18. As described in detail below, an imaging parameter, such as the bias voltage, can be adjusted responsive to the media being printed upon to provide optimum transfer of developing material 61 according to one aspect of the present invention.

The induced electric field causes the developing material 61 to move from imaging roller 52 to media sheet 18. Residual developing material (not shown) upon imaging roller 52 may be removed at cleaning station 64 to prepare imaging roller 52 for the application of a subsequent image.

Fuser 28 is positioned downstream of imager 24. Media travels in a downstream direction from imager 24 to fuser 28. Fuser 28 includes a fusing roller 66 and a pressure roller 68. Fusing roller 66 and pressure roller 68 are in contact at fuser nip 69. Media sheet 18 having developing material 61 thereon passes from imager 24 to fuser 28.

Media sheet 18 passes fusing roller 66 and pressure roller 68 at fuser nip 69. Fusing roller 66 preferably includes an internal heating element to impart heat flux to developing material 61 upon media sheet 18 as well as media sheet 18 itself. Application of such heat flux from fusing roller 66 fuses developing material 61 cohesively to media sheet 18. Temperatures of fusing roller 66 for providing optimum fusing are dependent upon the properties of developing material 61, the velocity of media sheet 18, the surface finish of media sheet 18, and the thermal conductivity and heat capacity of media sheet 18. Control of fusing operations responsive to media properties is described in detail in a U.S. patent application entitled "Image Forming Devices, Fusing Assemblies and Methods of Forming an Image", filed on the same day as the present U.S. patent application, naming Michael J. Martin, Nancy Cernusak, John Hoffman, Jeffrey S. Weaver, James G. Bearss and Thomas Camis as inventors, having Ser. No. 09/348,650, and incorporated herein by reference.

Figure 4:
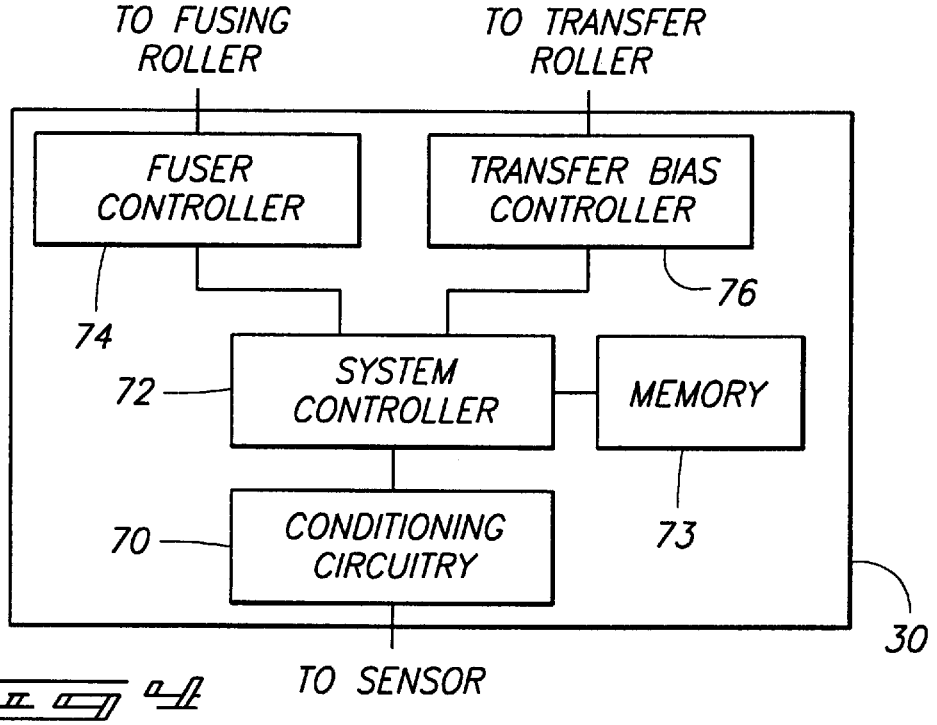
FIG. 4 is a functional block diagram of exemplary control circuitry of the image forming device.

Referring to FIG. 4, components of control circuitry 30 are illustrated. The depicted embodiment of control circuitry 30 includes conditioning circuitry 70, a system controller 72, a memory 73, a fuser controller 74 and a transfer bias controller 76. Control circuitry 30 can also include other circuitry, such as analog power circuits (not shown).

In the depicted arrangement, conditioning circuitry 70 is coupled with sensor 22, fuser controller 74 is coupled with fusing roller 66 and transfer bias controller 76 is coupled with transfer roller 54 (sensor 22, fusing roller 66 and transfer roller 54 are shown in FIG. 2).

System controller 72 comprises a digital microprocessor or microcontroller to implement print engine control operations in the described embodiment. System controller 72 is configured to execute a set of instructions provided as software or firmware of control circuitry 30. Fuser controller 74 operates to control fusing roller 66 and transfer bias controller 76 operates to control transfer roller 54.

Transfer roller 54 operates to attract developing material 61 from imaging roller 52 to media sheet 18 according to an imaging parameter. An exemplary imaging parameter is a bias voltage applied to transfer roller 66. The imaging parameter may be adjusted to provide optimized printing or other image creation regardless of the type of media being printed upon in accordance with one aspect of the present invention.

Sensor 22 is provided in the described embodiment to monitor the media for controlling imager 24. More specifically, sensor 22 is configured to determine or monitor qualitative and/or quantitative characteristics of the media and output a characteristic signal indicative of the qualitative and/or quantitative characteristics to conditioning circuitry 70. Control circuitry 30 receives characteristic signals generated from sensor 22 and controls adjustment of the imaging parameter of imager 24 responsive to the signals. In another embodiment, sensor 22 additionally monitors ambient conditions (e.g., temperature, humidity, etc.) and control circuitry 30 additionally controls adjustment of the imaging parameter responsive to the monitoring of ambient conditions.

As previously mentioned, sensor 22 applies characteristic signals to control circuitry 30. Conditioning circuitry 70 of control circuitry 30 receives the outputted characteristic signals from sensor 22 and applies respective conditioned signals to system controller 72. Exemplary conditioning circuitry 70 can include filtering circuitry to remove unwanted spikes, noise, etc.

Memory 73 stores a look-up table which includes a plurality of values which may be applied to fuser controller 74 and transfer bias controller 76 to control fusing and transfer operations, respectively. As described further below, system controller 72 generates indices responsive to characteristic signals outputted from sensor 22 to index the look-up table stored within memory 73. The look-up table values may be empirically derived to produce optimum settings for transfer bias controller 76 using media of known parameters and having known qualitative and quantitative characteristics. Thereafter, such look-up table values are accessed in real-time responsive to the monitoring of media using sensor 22 to provide optimized printing or other image formation within image forming device 10.

System controller 72 applies control signals to transfer bias controller 76 responsive to the look-up table values. The look-up table values can comprise voltage requirements for transfer roller 54 to provide a desired bias. Transfer bias controller 76 applies the voltage requirements to transfer roller 54 responsive to the characteristic signals. Thereafter, the appropriate imaging parameter (e.g., bias voltage) of imager 24 is adjusted responsive to control signals received from, control circuitry 30.

Figure 5:
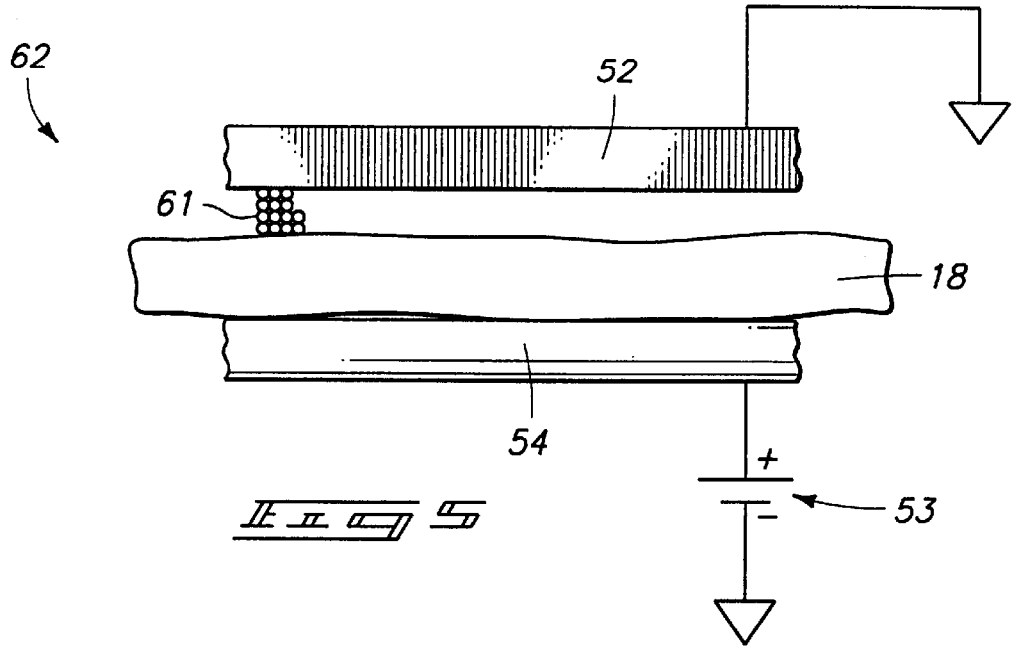
FIG. 5 is an illustrative representation of transfer operations of the imager.

Referring to FIG. 5, transfer operations of developing material 61 from imaging roller 52 to media sheet 18 occur within transfer nip 62. FIG. 5 illustrates media sheet 18 intermediate imaging roller 52 and transfer roller 54 within transfer nip 62. Imaging roller 52 is coupled with a ground node and thus is provided at a reference voltage condition. A positive voltage source 53 is coupled with transfer roller 54 as illustrated. Positive voltage source 53 is implemented within control circuitry 30 in one embodiment. Transfer bias controller 76 is configured to adjust the voltage bias applied to transfer roller 54 to provide optimized transfer of developing material 61 responsive to characteristic signals from sensor 22.

An electrical field is generated intermediate imaging roller 52 and transfer roller 54 due to the voltage potential intermediate imaging roller 52 and transfer roller 54. The generated electrical field tends to attract developing material 61 from imaging roller 52 toward transfer roller 54 and upon media sheet 18 within transfer nip 62.

The toner transfer fields generated within transfer nip 62 are dependent to some degree upon the capacitance of media sheet 18. Accordingly, in one aspect of the invention, sensor 22 is provided to monitor media being utilized and to generate a signal indicative of the monitoring. Thereafter, the transfer bias voltage applied to transfer roller 54 may be varied to provide optimum transfer levels for given media types. Such provides higher transfer efficiencies of developing material 61 from imaging roller 52 to media sheet 18. Further, optimization of the transfer fields also serves to retain unwanted debris, such as $CaCO_3$ and talc (magnesium silicates), upon media sheet 18 rather than having the debris accumulate upon imaging roller 52 or the fuser film surface.

Figure 6:
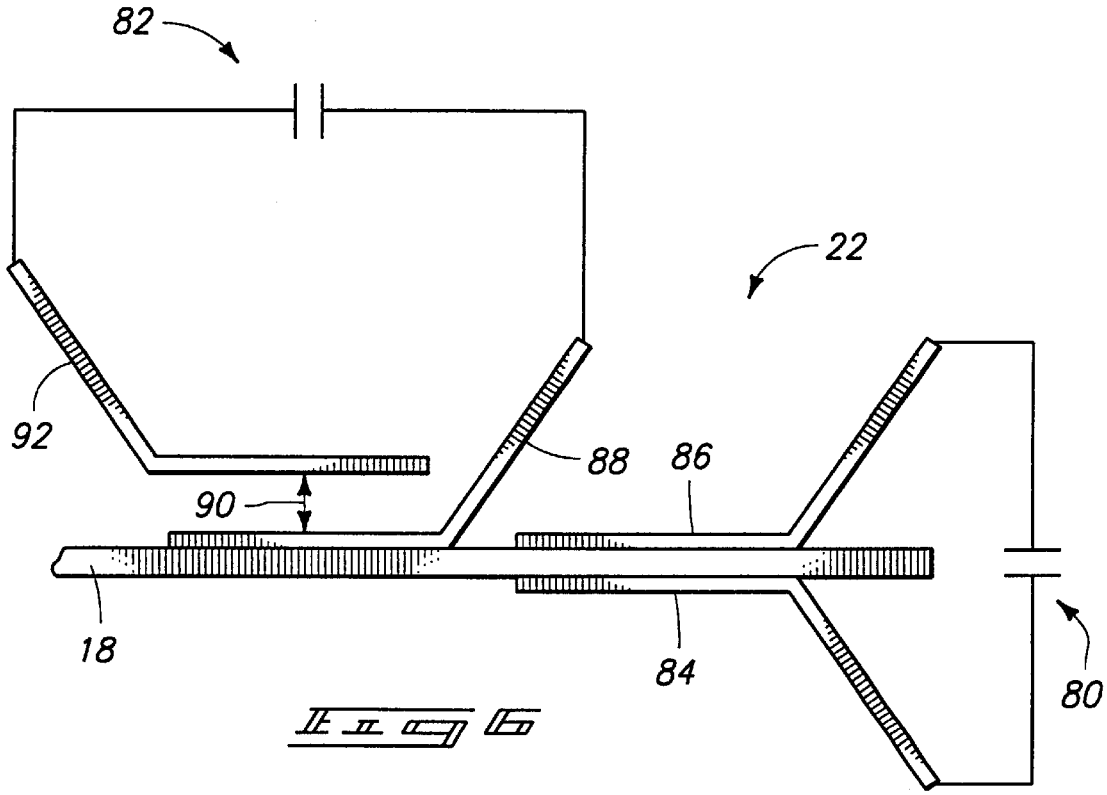
FIG. 6 is an illustrative representation of an exemplary sensor configuration provided upstream of the imaging assembly.
Figure 11:
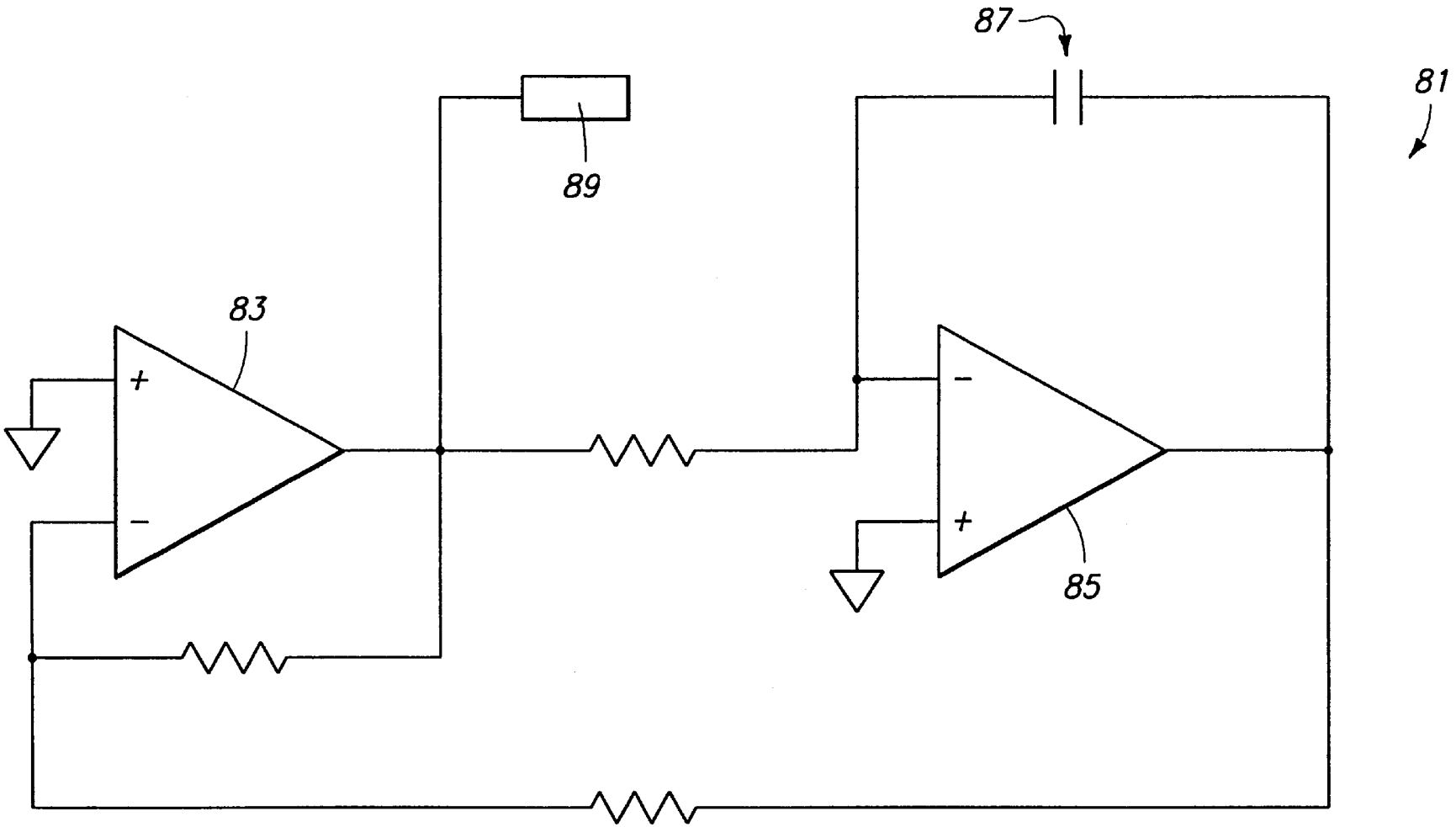

Referring to FIG. 6, one configuration of sensor 22 is illustrated. The depicted sensor 22 includes a first capacitor 80 and a second capacitor 82. Sensor 22 is located along media path 32 as shown in FIG. 2. Media sheet 18 is illustrated with respect to sensor 22 in FIG. 6.

Capacitor 80 is formed by a fixed electrode 84 and a moveable electrode 86. The electrical capacitance of capacitor 80 is determined by the electrode area, the thickness of media sheet 18 and the dielectric constant of the media. The dielectric thickness of the media may be derived from a measurement of the capacitance of capacitor 80.

The dielectric thickness of media sheet 18 may be represented by $D_{media}$ and is equal to the permativity of free space constant $\epsilon_0$ divided by the capacitance per unit area ($D_{media}$=

$\epsilon_0/C_{media}/A_{electrodes}$) being measured by sensor 22. More specifically, $C_{media}$ is the capacitance of capacitor 80 and $A_{electrodes}$ is the area of the electrodes of capacitor 80. Appropriate adjustments to the transfer electrical bias generated by voltage source 53 can be made based upon the changes in capacitance per unit area measured by capacitor 80 of sensor 22.

It is preferred to maintain the electrical field induced to developing material 61 at a relatively constant value. The electrical field induced by the application of the voltage bias to transfer roller 54 may be represented by the following equation:

$$E_{toner} = \frac{(1/k_t)[V_{transfer} - (pL_t/\varepsilon_0)(D_t/2 + D_{opc}) - V_{opc}]}{D_{opc} + D_t + D_{air} + D_{media}}$$

In the above equation, $k_t$ is the dielectric constant of the toner, $V_{transfer}$ is the voltage bias supply to transfer roller 54 using source 53, p is the volume charge density of the toner, $L_t$ is the physical thickness of the toner, $D_t$ is the dielectric thickness of the toner, $D_{opc}$ is the dielectric thickness of imaging roller 52, $V_{opc}$ is the voltage potential of imaging roller 52, $D_{air}$ is the dielectric thickness of air and $D_{media}$ is the dielectric thickness of media sheet 18 as determined using measurements from capacitor 80 of sensor 22 according to one aspect of the invention.

In the exemplary embodiment described herein, the dielectric thickness of the media can be determined utilizing the measured electrical capacitance of media sheet 18 using capacitor 80 of sensor 22. Accordingly, approximate voltage biases of source 53 for providing desired transfer fields can be determined using the dielectric thickness of the media and the above equation. Further, empirically derived voltage bias values can be determined using media having known parameters within image forming device 10. Such empirical voltage bias values can be provided within the look-up table stored within memory 73 and subsequently accessed by system controller 72 responsive to the monitoring of media sheet 18 using capacitor 80 of sensor 22.

The physical thickness of media sheet 18 is determined using capacitor 82. Second capacitor 82 is formed by a moveable electrode 88, air gap 90 and fixed electrode 92. The capacitance of capacitor 82 is determined by the electrode area, air gap 90 and the dielectric constant of air (typically stable at 1.0). Air gap 90 is a function of the thickness of media sheet 18 inasmuch as moveable electrode 88 adjusts to the height of media sheet 18. Thus, the physical thickness of media sheet 18 may be derived from a measurement of second capacitor 82. The physical thickness measurement of media sheet 18 may be utilized to adjust the transfer electrical bias as described below.

Empirically derived voltage bias values can be determined corresponding to the physical thicknesses of the media. Such values can be stored within memory 73 and subsequently accessed by system controller 72 responsive to the monitoring of media sheet 18 using capacitor 82 of sensor 22. One or both of the parameters determined by respective capacitors 80, 82 may be utilized to provide desired transfer fields. It is preferred to use measurements from both capacitors 80, 82 to control the transfer voltage bias.

Referring to FIG. 7, an exemplary circuit 81 is illustrated for measuring the capacitance of first capacitor 80 or second capacitor 82. The depicted circuit 81 is a dual-slope integrator circuit. Circuit 81 includes plural amplifiers 83, 85 configured as shown. Capacitor 87 is the capacitor-under-test and is used as a timing element in circuit 81. Circuit 81 creates a square-wave signal at output 89 whose frequency is determined by the capacitance of capacitor-under-test 87.

First capacitor 80 and second capacitor 82 can be individually provided as capacitor-under-test 87 to provide monitoring thereof. Plural circuits 81 can be provided to provide simultaneous monitoring of capacitors 80, 82. Alternatively, electrodes 86, 88 could be combined into a single electrode. Circuit 81 could utilize a switch (not shown) to selectively provide one of capacitor 80 and capacitor 82 into circuit 81. The capacitance of capacitors 80, 82 could thereafter be measured sequentially. The measured capacitance represented by a signal at output 89 is applied to control circuitry 30.

Figure 8:
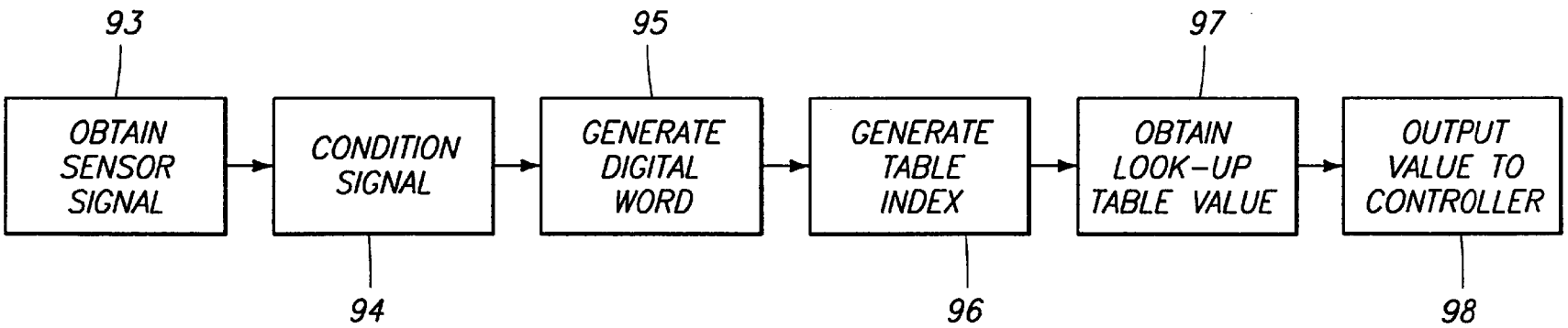
FIG. 8 is functional block diagram illustrating exemplary operations of the image forming device.

Referring to FIG. 8, operations for controlling an imaging parameter of imager 24 are described. The imaging parameter is controlled responsive to the monitoring of qualitative and/or quantitative characteristics of the media in accordance with one aspect of the present invention. Initially, sensor signals from sensor 22 corresponding to measured capacitance values of capacitors 80, 82 are obtained as represented by step 93. The sensor signals correspond to the dielectric thickness of the media and the physical thickness of the media.

Signals of varying frequency are generated responsive to changes in capacitance of capacitors 80, 82. Capacitors 80, 82 can be coupled with conditioning circuitry 70 to provide appropriate conditioning for utilization within transfer bias controller 76 at step 94. Exemplary conditioning includes filtering to remove extraneous spikes, as well as changing the format of the outputted signals. For example, varying capacitance values can be converted to varying frequency value signals within conditioning circuitry 70 comprising circuit 81.

Thereafter, digital words are generated corresponding to the conditioned signals in step 95. In one configuration, system controller 72 includes timer/counter circuitry (not shown) configured to generate digital words responsive to conditioned signals from circuitry 70. Such circuitry converts frequency varying signals into respective digital words in the described embodiment.

System controller 72 generates table indices from the digital words at step 96. Responsive to the generation of the table indices, look-up table values can be retrieved from memory 73 at step 97. The values can be empirically derived look-up table values for providing optimum transfer bias settings to transfer bias controller 76 responsive to the digital words and table indices. At step 98, the determined look-up table values are provided to transfer bias controller 76 to control imager 24.

Figure 9:
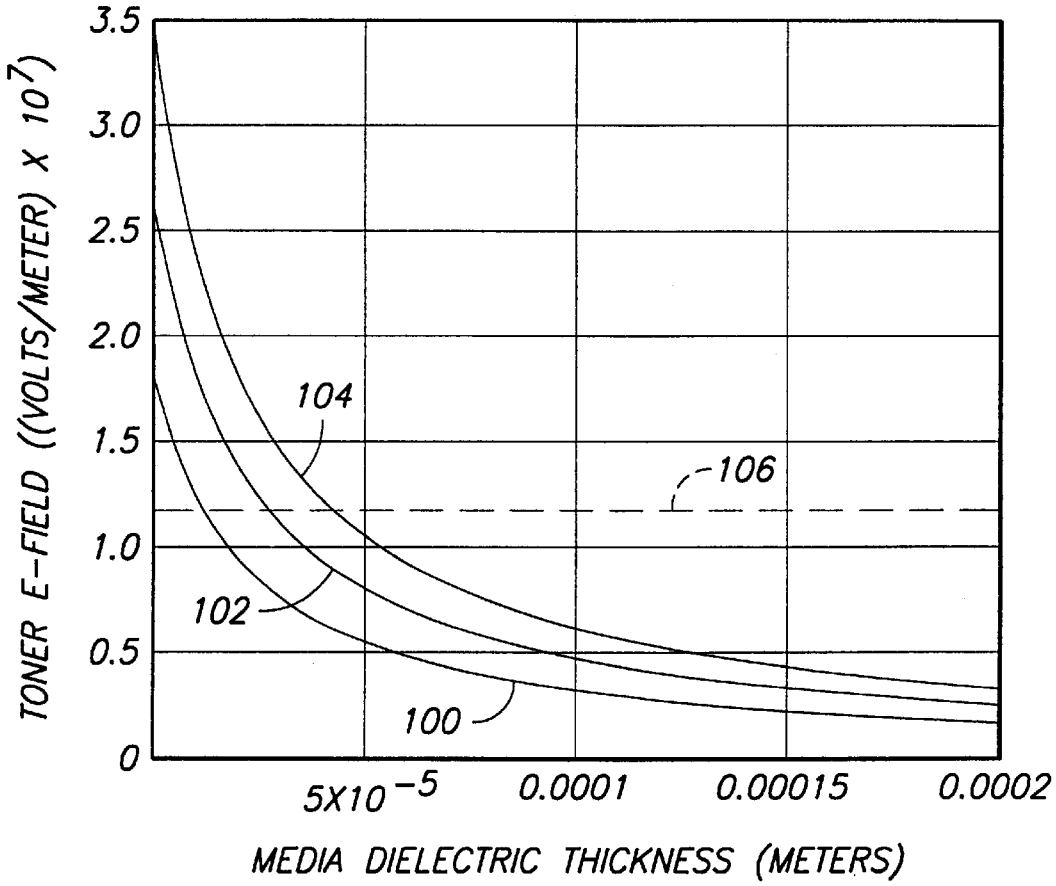
FIG. 9 is a graphical representation of a relationship of transfer electrical fields and dielectric thickness of media.

Referring to FIG. 9, a graphical representation of effects of media dielectric thickness upon electrical fields induced within developing material 61 within transfer nip 62 is illustrated. Plural lines 100, 102, 104 are illustrated upon the depicted graph. Line 100 corresponds to a transfer bias applied to transfer roller 54 of 1,000 Volts. Line 102 corresponds to a transfer bias of 1,500 Volts. Line 104 corresponds to a transfer bias of 2,000 Volts.

As illustrated, the transfer bias can be adjusted to provide a substantially constant induced electrical field upon developing material 61 as represented by line 106. As the media dielectric thickness increases due to a given type media, the transfer bias voltage applied to transfer roller 54 can be increased to maintain the induced electrical field at a substantially constant value. Voltage settings of 1,000, 1,500 and 2,000 Volts provide a toner transfer field strength of about 12 Volts/micron for corresponding media dielectric thicknesses of 12 microns, 26 microns and 42 microns, respectively.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An image forming device comprising:

a housing including a media path;

an input device configured to receive image data;

a sensor positioned adjacent the media path and configured to monitor a qualitative characteristic of media within the media path and to generate a signal responsive to the monitoring; and an imager positioned adjacent the media path and configured to provide developing material corresponding to the image data upon the media according to an imaging parameter and to adjust the imaging parameter responsive to the signal.

2. The image forming device according to claim 1 wherein the sensor is configured to monitor the qualitative characteristic comprising dielectric thickness of the media.

3. The image forming device according to claim 1 wherein the sensor is configured to monitor a quantitative characteristic of the media.

4. The image forming device according to claim 1 wherein the sensor is configured to monitor the media while the media is moving within the media path.

5. The image forming device according to claim 1 wherein the sensor is configured to monitor the qualitative characteristic comprising dielectric thickness of the media while the media is moving within the media path.

6. The image forming device according to claim 1 wherein the imager includes:

an imaging roller positioned adjacent the media path and configured to receive the developing material; and a transfer roller adjacent the imaging roller and positioned to receive media between the imaging roller and the transfer roller; and the image forming device further comprises:

a voltage source configured to apply the imaging parameter comprising a bias voltage to the transfer roller to attract the developing material from the imaging roller to the media; and a controller coupled with the sensor and configured to control the bias voltage applied by the voltage source responsive to the signal.

7. The image forming device according to claim 1 wherein the sensor comprises a capacitor.

8. An imaging assembly of an image forming device comprising:

a sensor configured to monitor a qualitative characteristic of media within a media path of an image forming device and to generate a signal responsive to the monitoring;

a controller coupled with the sensor and configured to receive the signal and to adjust an imaging parameter responsive to the signal; and an imager positioned adjacent the media path and coupled with the controller and configured to provide developing material upon the media according to the imaging parameter.

9. The imaging assembly according to claim 8 wherein the sensor is configured to monitor the qualitative characteristic comprising dielectric thickness of the media.

10. The imaging assembly according to claim 8 wherein the sensor is configured to monitor a quantitative characteristic of the media.

11. The imaging assembly according to claim 8 wherein the sensor is configured to monitor the media while the media is moving within the media path.

12. The imaging assembly according to claim 8 wherein the sensor is configured to monitor the qualitative characteristic comprising dielectric thickness of the media while the media is moving within the media path.

13. The imaging assembly according to claim 8 wherein the sensor comprises a capacitor.

14. A method of forming an image upon media comprising:

providing an image forming device;

providing image data;

transferring developing material corresponding to the image data to media according to an imaging parameter;

monitoring a qualitative characteristic of the media; and adjusting the imaging parameter responsive to the monitoring.

15. The method according to claim 14 wherein the monitoring comprises monitoring the qualitative characteristic comprising dielectric thickness of the media.

16. The method according to claim 14 wherein the monitoring further comprises monitoring a quantitative characteristic of the media.

17. The method according to claim 14 wherein the monitoring comprises monitoring the media while the media is moving within the media path.

18. The method according to claim 14 wherein the monitoring comprises monitoring the qualitative characteristic comprising dielectric thickness of the media while the media is moving within the media path.

19. The method according to claim 14 wherein the transferring comprises transferring according to the imaging parameter comprising a voltage bias to attract the developing material of the image to the media; and the adjusting comprises adjusting the voltage bias.

20. The method according to claim 14 wherein the monitoring comprises monitoring using a capacitor.

21. An imaging forming device comprising:

a housing configured to guide media along a media path;

an input device configured to receive an image;

a sensor adjacent the media path and configured to monitor the media and to generate a signal responsive to the monitoring, wherein the sensor comprises:

a first capacitor having plural conductive plates positioned adjacent opposing sides of the media path; and a second capacitor having a fixed conductive plate and a moveable conductive plate positioned adjacent one side of the media path; and an imager adjacent the media path and configured to provide developing material corresponding to the image upon the media according to an imaging parameter and to adjust the imaging parameter responsive to the signal.

22. An imaging assembly of an image forming device comprising:

a sensor configured to monitor media traveling along a media path of an image forming device and to generate a signal responsive of the monitoring, wherein the sensor comprises:

a first capacitor having plural conductive plates positioned adjacent opposing sides of the media path; and a second capacitor having a fixed conductive plate and a moveable conductive plate positioned adjacent one side of the media path;

a controller coupled with the sensor and configured to receive the signal and to adjust an imaging parameter responsive to the signal; and an imager adjacent the media path and coupled with the controller and configured to provide developing material upon the media according to the imaging parameter.

23. A method of forming an image upon media comprising:

providing an image forming device;

providing an image;

transferring developing material corresponding to the image to media according to an imaging parameter;

monitoring the media comprising:

passing the media intermediate opposing conductive plates of a first capacitor; and passing the media adjacent one moveable conductive plate of a second capacitor; and adjusting the imaging parameter responsive to the monitoring.

* * * * *